US012644241B2

(12) United States Patent
Betz et al.

(10) Patent No.: US 12,644,241 B2
(45) **Date of Patent: *Jun. 2, 2026**

(54) PISTE GROOMING VEHICLE

(71) Applicant: Kässbohrer Geländefahrzeug AG, Laupheim (DE)

(72) Inventors: Peter Betz, Baustetten (DE); Olivier Hargoaa, Domene (FR); Michael Kuhn, Achstetten (DE); Jens Rottmair, Siefersheim (DE); Jonathan Zimmermann, Burgrieden (DE)

(73) Assignee: KÄSSBOHRER GELÄNDEFAHRZEUG AG, Laupheim (DE)

( * ) Notice: Subject to any disclaimer, the term of this patent is extended or adjusted under 35 U.S.C. 154(b) by 390 days.

This patent is subject to a terminal disclaimer.

(21) Appl. No.: 18/413,178

(22) Filed: Jan. 16, 2024

(65) Prior Publication Data

US 2024/0150982 A1 May 9, 2024

Related U.S. Application Data

(63) Continuation of application No. 16/593,442, filed on Oct. 4, 2019, now Pat. No. 11,970,828.

(30) Foreign Application Priority Data

Oct. 5, 2018 (DE) ..... 10 2018 217 049.5

(51) Int. Cl.
*E01H 4/02* (2006.01)

(52) U.S. Cl.
CPC ..... *E01H 4/02* (2013.01)

(58) Field of Classification Search
CPC ..... E01H 4/02; E01H 4/023
(Continued)

(56) References Cited

U.S. PATENT DOCUMENTS 5,925,085 A 7/1999 Kleimenhagen et al.
6,466,870 B2 10/2002 Satonaka
(Continued)

FOREIGN PATENT DOCUMENTS

AT 500147 B1 1/2007
DE 3416246 C1 10/1985
(Continued)

OTHER PUBLICATIONS

German Office Action issued in corresponding German Application No. 10 2018 217 049.5, dated Sep. 6, 2019 (6 pages).
(Continued)

*Primary Examiner* — Christopher J Sebesta
*Assistant Examiner* — Audrey L Lusk
(74) *Attorney, Agent, or Firm* — FLYNN THIEL, P.C.

(57) ABSTRACT

A piste grooming vehicle having at least one piste grooming device for preparing a piste. The piste grooming vehicle has a detection device configured to detect an actual topography of a piste section, positioned in front of the piste grooming vehicle in the forward travel direction thereof, of the piste, a determining device connected to the detection device and configured to determine at least one differential value between coordinates of the actual topography and coordinates of a reference topography of the piste, and a control device connected to the determining device and configured to actuate the at least one piste grooming device in accordance with the at least one determined differential value.

14 Claims, 3 Drawing Sheets

(58) Field of Classification Search
USPC ..... 37/197, 219
See application file for complete search history.

(56) References Cited

U.S. PATENT DOCUMENTS

| | | | | |
|---|---|---|---|---|
| 6,655,465 | B2 | 12/2003 | Carlson et al. | |
| 6,671,600 | B1 * | 12/2003 | Hintzy | G05D 1/0278 701/485 |
| 6,725,580 | B2 | 4/2004 | Eriksson et al. | |
| 7,299,569 | B2 * | 11/2007 | Kanzler | E01H 4/02 701/50 |
| 7,740,094 | B2 * | 6/2010 | Pelletier | B62D 55/06 37/219 |
| 8,695,237 | B2 | 4/2014 | Melville | |
| 9,050,725 | B2 * | 6/2015 | Shull | B25J 9/1664 |
| 10,612,202 | B1 | 4/2020 | Jones | |
| 10,774,505 | B2 * | 9/2020 | Fujii | E02F 3/841 |
| 2002/0116122 | A1 * | 8/2002 | Satonaka | F25C 3/04 342/357.57 |
| 2002/0162668 | A1 * | 11/2002 | Carlson | E02F 9/26 172/1 |
| 2009/0069987 | A1 * | 3/2009 | Omelchenko | E02F 9/2045 701/50 |
| 2014/0278696 | A1 | 9/2014 | Anderson | |
| 2015/0240453 | A1 * | 8/2015 | Jaliwala | G01S 19/14 701/50 |
| 2016/0024757 | A1 | 1/2016 | Nomura et al. | |
| 2016/0170090 | A1 | 6/2016 | Collins | |
| 2018/0245311 | A1 | 8/2018 | Shike et al. | |
| 2019/0078297 | A1 * | 3/2019 | Ishibashi | G05D 1/0246 |
| 2019/0390443 | A1 * | 12/2019 | Yamamoto | E02F 9/264 |
| 2020/0109532 | A1 * | 4/2020 | Betz | E01H 4/02 |
| 2020/0224391 | A1 | 7/2020 | Seki et al. | |
| 2020/0263389 | A1 | 8/2020 | Harada | |
| 2021/0108395 | A1 * | 4/2021 | Harada | E02F 9/2045 |
| 2022/0002958 | A1 * | 1/2022 | Kirchmair | E01H 4/02 |
| 2023/0042695 | A1 * | 2/2023 | Cloud | E02F 3/847 |
| 2023/0184476 | A1 * | 6/2023 | Behmüller | G05B 15/02 700/28 |
| 2023/0228050 | A1 * | 7/2023 | Salis | E01H 4/02 37/219 |

FOREIGN PATENT DOCUMENTS

| | | | | |
|---|---|---|---|---|
| DE | 10045524 | A1 * | 3/2002 | E01H 4/02 |
| DE | 102016212326 | A1 | 1/2018 | |
| EP | 0160195 | A2 | 11/1985 | |
| EP | 2071281 | A1 | 6/2009 | |
| EP | 2354316 | A1 * | 8/2011 | F16P 3/142 |
| EP | 4286591 | A1 * | 12/2023 | E01H 4/02 |
| JP | 201333426 | A | 2/2013 | |
| WO | WO-0116560 | A2 * | 3/2001 | E01H 4/02 |
| WO | 2018097971 | A1 | 5/2018 | |

OTHER PUBLICATIONS

European Search Report Issued in corresponding European Application No. 19198833.6 with English translation of categories of cited documents, dated Feb. 26, 2020 (8 pages).

Notice of Opposition issued in corresponding European Patent No. 3633107 (European Patent Application No. 19198833.6), dated Jan. 5, 2023 (1 page).

Thomas R. Kurfess, Robotics and Automation Handbook, CRC Press, 2005 (579 pages).

Screenshot of a Youtube video, SNOWsat Snow Depth Measurement and Fleet Management; website: https://www.youtube.com/watch?v=s_6EMmerCJQ (2016)(1 page).

Jeffrey S. Deems et al., Lidar measurement of snow depth: A review, Journal of Glaciology, vol. 59, No. 215, 2013, pp. 467-479 (14 pages).

Roberto Ferrari, Autonomous Driving and Operation in Agriculture and Off-Highway, Slideshow and Declaration of Mr. Roberto Ferrari regarding an oral disclosure at the conference "Meccatronica & smart farming" held in 2017 at Museo Lamborghini (19 pages).

Elena Castello, Meccatronica e smart farming, Journal Progettare, Metal Work Pneumatic, No. 407, Jun./Jul. 2017, pp. 30 and 31 (3 pages).

* cited by examiner

PISTE GROOMING VEHICLE

CROSS-REFERENCE TO RELATED APPLICATIONS

This is a continuation of prior U.S. application Ser. No. 16/593,442, filed Oct. 4, 2019, which claims priority to German Application No. 10 2018 217 049.5, filed Oct. 5, 2018, the entire contents of which are hereby incorporated by reference.

TECHNICAL FIELD

The invention relates to a piste grooming vehicle having at least one piste grooming device for preparing a piste and to a method for operating such a piste grooming vehicle.

BACKGROUND

Such a piste grooming vehicle is known from DE 100 45 524 A1 and has a piste grooming device in the form of a snow blower which is mounted on the rear side and has a smoothing apparatus arranged behind the snow blower. The piste grooming device is provided for preparing a snow-covered ski piste or snowboard piste. In order to ensure a preparation result which is as constant as possible, the piste grooming vehicle has a camera which captures a piste section of the pistes which is arranged behind the piste grooming device—when viewed in the direction of travel of the piste grooming vehicle—and which is therefore completely prepared. In addition, a signal processing unit is provided by means of which an image of the piste section which is captured by the camera is evaluated. Furthermore, a control device is provided by means of which a setting parameter of the snow blower can be left unchanged or can be changed depending on the evaluation of the captured image.

The object of the invention is to make available a method and a piste grooming vehicle of the type mentioned at the beginning, which method and vehicle permit further improved piste grooming.

The method according to the invention for operating a piste grooming vehicle has the steps: a) detecting an actual topography of a piste section, positioned in front of the piste grooming vehicle in the forward travel direction thereof, of the piste; b) determining at least one differential value between coordinates of the actual topography and coordinates of a reference topography of the piste; and c) actuating the at least one piste grooming device in accordance with the at least one determined differential value. The solution according to the invention can, of course, detect a continuously present change in the topography of the piste, which can be caused, for example, by snow fall, melting of snow or transportation of snow, even before a piste section to be prepared is traveled on, and said change can be taken into account during the actuation of the piste grooming device. As a result, the piste grooming device can, as it were, be actuated in a predictive fashion and ultimately piste grooming which is improved with respect to the quality of the piste can be achieved.

Step a) comprises detecting the actual topography of the piste section which is positioned in front of the piste grooming vehicle. The piste section is therefore detected in terms of measuring technology before it is traveled on with the piste grooming vehicle and therefore before the preparation by means of the piste grooming device. During the detection in terms of measuring technology, the piste section which is positioned in front is scanned in a contactless fashion by means of basically known measuring methods for sensing surroundings. On the basis of the measured values which are acquired as a result, the actual topography of the piste can be stored or buffered, for example, in the form of a data-based actual surface model, and as a result made available to be taken into account in further method steps.

Step b) comprises a comparison between the detected actual topography and the reference topography of the piste. The reference topography describes the surface of the piste to be prepared, with respect to a reference state. This reference state can be, for example, a setpoint state which is to be produced by means of the preparation of the piste. Alternatively, the reference state can be, for example, a snow-free state of the piste so that the reference topography describes a snow-free surface state of the piste. As a further alternative, the reference topography can describe a state of the piste which chronologically precedes the intended grooming. For example, the reference topography can represent the surface of the piste on the previous day. The reference topography can be present, for example, in the form of a data-based surface model. The differential value between the coordinates of the actual topography and the coordinates of the reference topography therefore represents a geometric deviation between the actual state and the reference state of the piste surface. In so far as the reference topography relates to a state chronologically preceding the piste grooming, the differential value therefore describes a geometric change in the piste surface over time and therefore, for example, a change in the snow depth in so far as the piste is a snow piste.

Step c) comprises actuating the piste grooming device in accordance with the previously occurred comparison between the actual topography and the reference topography. In this context, at least one manipulated variable of the piste grooming device is preferably changed in accordance with the determined differential value. The manipulated variable can be, for example, a contact pressure, a preparation speed, a vertical setting or inclination setting or the like of the piste grooming device. The piste grooming device is preferably embodied in the form of a front attachment device which is arranged on the front with respect to the forward travel direction of the piste grooming vehicle.

The method according to the invention is particularly advantageously suitable for operating a piste grooming vehicle for grooming ski pistes or snowboard pistes with a piste grooming device in the form of a front attachment device, such as for example a snow plow, a half pipe or quarter pipe snow blower, a device for forming fun parks, such as the PARKBLADE™, or the like, arranged on the front in the forward travel direction.

In one configuration of the invention, step a) comprises the steps: a1) detecting the coordinates of the actual topography with respect to a local vehicle coordinate system which is assigned to the piste grooming vehicle; a2) detecting a location and a position of the piste grooming vehicle and therefore of the local vehicle coordinate system with respect to a global reference coordinate system on which the coordinates of the reference topography are based; and a3) transforming the detected coordinates of the actual topography into the reference coordinate system as a function of the determined location and the position of the vehicle coordinate system. This configuration of the invention permits, in particular, detection of the actual topography on the basis of the piste grooming vehicle. As a result, it is possible to dispense, in particular, with detection devices which are arranged in a stationary fashion for detecting the actual topography. This is particularly advantageous in so far as the piste which is to be groomed is a ski piste or snowboard piste, since any detection devices which are arranged in a stationary fashion on the piste can constitute an obstacle and therefore a potential safety risk for skiers or snowboarders who are moving on the piste.

Step a1) comprises a determination in terms of measuring technology of the coordinates describing the actual topography of the piste surface, on the basis of the piste grooming vehicle. A detection device which is arranged on the piste grooming vehicle can be provided for this. The coordinates of the actual topography are therefore detected with respect to the local vehicle coordinate system. The vehicle coordinate system can be varied in terms of its location and position depending on the driving state and moves, as it were, over the piste together with the piste grooming vehicle. As a result, the driving-state-dependent change in the location and/or position of the piste grooming vehicle superimposes and distorts the coordinates of the actual topography, detected in step a1)—with respect to a positionally-fixed, virtual reference coordinate system. In order to take this into account, step a2) comprises detection of the location and position of the piste grooming vehicle with respect to a global reference coordinate system on which the coordinates of the reference topography are based. The global reference coordinate system is a virtual, positionally-fixed reference coordinate system. The current location of the piste grooming vehicle and therefore of the local vehicle coordinate system can be determined, for example, by means of a GPS location system. The position of the piste grooming vehicle or of the local vehicle coordinate system in space can be detected, for example, by means of a sensor system which is suitable for this purpose and which can have preferably basically known inertial sensors. Step a3) comprises coordinate transformation which is basically known per se and therefore establishes a reference of the coordinates, detected in step a1), of the actual topography with respect to the global reference coordinate system. If this reference is established, the at least one difference value can easily be determined directly in step b).

In a further configuration of the invention, the differential value is a difference between an altitude coordinate of the actual topography and an altitude coordinate of the reference topography. In this case, the differential value describes, for example, a difference in snow depth between an actual state and a reference state of the piste surface. This difference in snow depth can result, for example, from snow fall or transportation of snow on the basis of a reference state, determined on the previous day, of the piste surface. Alternatively, the difference in snow depth can describe a deviation of the actual state from a reference state and therefore setpoint state of the piste surface which reference state is to be established by means of the piste grooming device.

In a further configuration of the invention, the actuation of the at least one piste grooming device comprises changing a location and/or a position of the piste grooming device relative to the determined actual topography. The location and/or position constitute a control variable of the piste grooming device. If the piste grooming device is, for example, a snow plow which is arranged on the front, the position can be a lifting position, and the position can be an inclination of the snow plow with respect to the piste surface.

In a further configuration of the invention, the method has the step: d) displaying the determined actual topography in the form of a virtual terrain model. The virtual terrain model can be displayed as a two-dimensional or three-dimensional terrain model of the piste section which is positioned in front. Through the displaying of the terrain model, a vehicle driver of the piste grooming vehicle receives additional information which may be helpful, in particular, when visibility is impaired owing to the weather or time of day. The displayed virtual terrain model can make it possible to detect, in particular, obstacles which are positioned in front of the piste grooming vehicle in the forward travel direction. Alternatively or additionally, the virtual terrain model can make it possible to detect whether the piste section which is positioned in front has already been groomed or not. The displaying of the actual topography preferably is carried out with respect to the global reference coordinate system.

In a further configuration of the invention, step d) comprises displaying the virtual terrain model by means of a screen and/or a headsup display and/or data glasses.

The piste grooming vehicle according to the invention can be operated according to the method described above, is configured to carry out the method described above and has: a detection device which is configured to detect an actual topography of a piste section, positioned in front of the piste grooming vehicle in the forward travel direction thereof, of the piste; a determining device which is connected to the detection device and which is configured to determine at least one differential value between coordinates of the actual topography and coordinates of a reference topography of the piste; and a control device which is connected to the determining device and which is configured to actuate the at least one piste grooming device in accordance with the at least one determined differential value. The solution according to the invention can detect deviations between the actual topography and the reference topography of the piste already before a piste section which is to be prepared is traveled on, and said deviations can be correspondingly taken into account during the actuation of the piste grooming device. As a result, the piste grooming device can be, as it were, actuated predictively and ultimately piste grooming which is improved with respect to the quality of the piste can be achieved. The detection device is arranged on the piste grooming vehicle in such a way that the piste section which is positioned in front can be detected in terms of measuring technology by means of the detection device. The detection device preferably has a sensor system for optically or acoustically scanning the piste surface. Such sensor systems are basically known per se in the field of the sensing of surroundings. The detection device is configured, in particular, to execute step a) of the method according to the invention. The determining device serves, in particular, to carry out a data-based comparison between the actual topography and the reference topography. The reference topography can be stored in a data-based fashion, for example, in an electronic memory unit which is assigned to the determining device, and said reference topography can be retrievable for the purpose of the comparison with data on which the actual topography is based. The determining device is configured, in particular, to execute step b) of the method according to the invention. The control device serves to control the piste grooming device. At least one manipulated variable of the piste grooming device can be changed by means of the control device. The piste grooming device is preferably embodied in the form of a front attachment device which is arranged on the front with respect to the forward travel direction. The control device is configured, in particular, to execute step c) of the method according to the invention.

In one configuration of the invention, the detection device is configured to detect the coordinates of the actual topography with respect to a local vehicle coordinate system which is assigned to the piste grooming vehicle, and the detection device is configured to detect a location and a position of the piste grooming vehicle and therefore of the local vehicle coordinate system with respect to a global reference coordinate system on which the coordinates of the reference topography are based, and the determining device is configured to transform the detected coordinates of the actual topography into the reference coordinate system in accordance with the determined location and position of the vehicle coordinate system. The detection device is therefore configured, in particular, to execute steps a1) and a2). The determining device is configured, in particular, to execute step a3) of the method. Moreover, reference is made additionally, and in order to avoid repetitions, to the disclosure relating to the above-mentioned steps a1), a2) and a3) of the method, which disclosure applies correspondingly to this configuration of the piste grooming vehicle according to the invention.

In a further configuration of the invention, the detection device has a lidar system which is arranged oriented in the forward travel direction in such a way that the piste section which is positioned in front of the piste vehicle can be detected in terms of measuring technology by means of the lidar system. Lidar systems are basically known per se in the field of the sensing of surroundings in terms of measuring technology. The lidar system serves for optically scanning the piste surface by means of lasers and therefore for detecting the actual topography of the piste surface.

In a further configuration of the invention, the detection device has a GPS unit, which is configured to detect the location of the piste grooming vehicle with respect to the reference coordinate system and the detection device has a position-measuring unit which is configured to detect the position of the piste grooming vehicle with respect to the reference coordinate system. The GPS unit accordingly serves for performing satellite-based position determination of the piste grooming vehicle and therefore of the vehicle coordinate system. The position-measuring unit serves to detect the spatial position of the piste grooming vehicle and preferably has for this purpose at least one inertial sensor, basically known per se, for measuring angles. By means of the GPS unit and the position-measuring unit it is accordingly possible to establish a relationship between the local vehicle coordinate system, which is based on the detection of the actual topography, and the global reference coordinate system, which is based on the coordinates of the reference topography.

In a further configuration of the invention, the determining device has a processor unit which is configured to perform data-based transformation of the detected coordinates of the actual topography into the global reference coordinate system and to calculate the at least one differential value between the transformed coordinates of the actual topography and the coordinates of the reference topography. The processor unit serves accordingly to perform computer-assisted evaluation of the measured values or data which are collected by means of the detection device.

In a further configuration of the invention, the piste grooming device has a snow plow which is arranged on the front—with respect to the forward travel direction—wherein the control device is configured to actuate the snow plow with respect to a change in a location and/or a position of the snow plow relative to the actual topography. The position is preferably a lifting position, and the position is preferably a longitudinal inclination and/or transverse inclination of the snow plow relative to the piste surface.

In a further configuration of the invention, a display device is provided which is configured to display the determined actual topography in the form of a virtual terrain model. The display device serves in particular as a type of visual aid for a vehicle driver of the piste grooming vehicle in the case of visibility conditions being restricted owing to the weather or time of day. On the basis of the virtual terrain model which can be displayed by means of the display device and which can be displayed as a two-dimensional or three-dimensional model, the vehicle driver receives additional information relating to the piste section which is positioned in front. In particular, the virtual terrain model can make it possible to detect obstacles or the fact that the piste section has already been groomed.

In a further configuration of the invention, the display device has a screen and/or a headsup display and/or data glasses.

BRIEF DESCRIPTION OF THE DRAWINGS

Further advantages and features of the invention can be found in the claims and in the following description of preferred exemplary embodiments of the invention which are illustrated by means of the drawings, in which:

DETAILED DESCRIPTION

Figure 1:
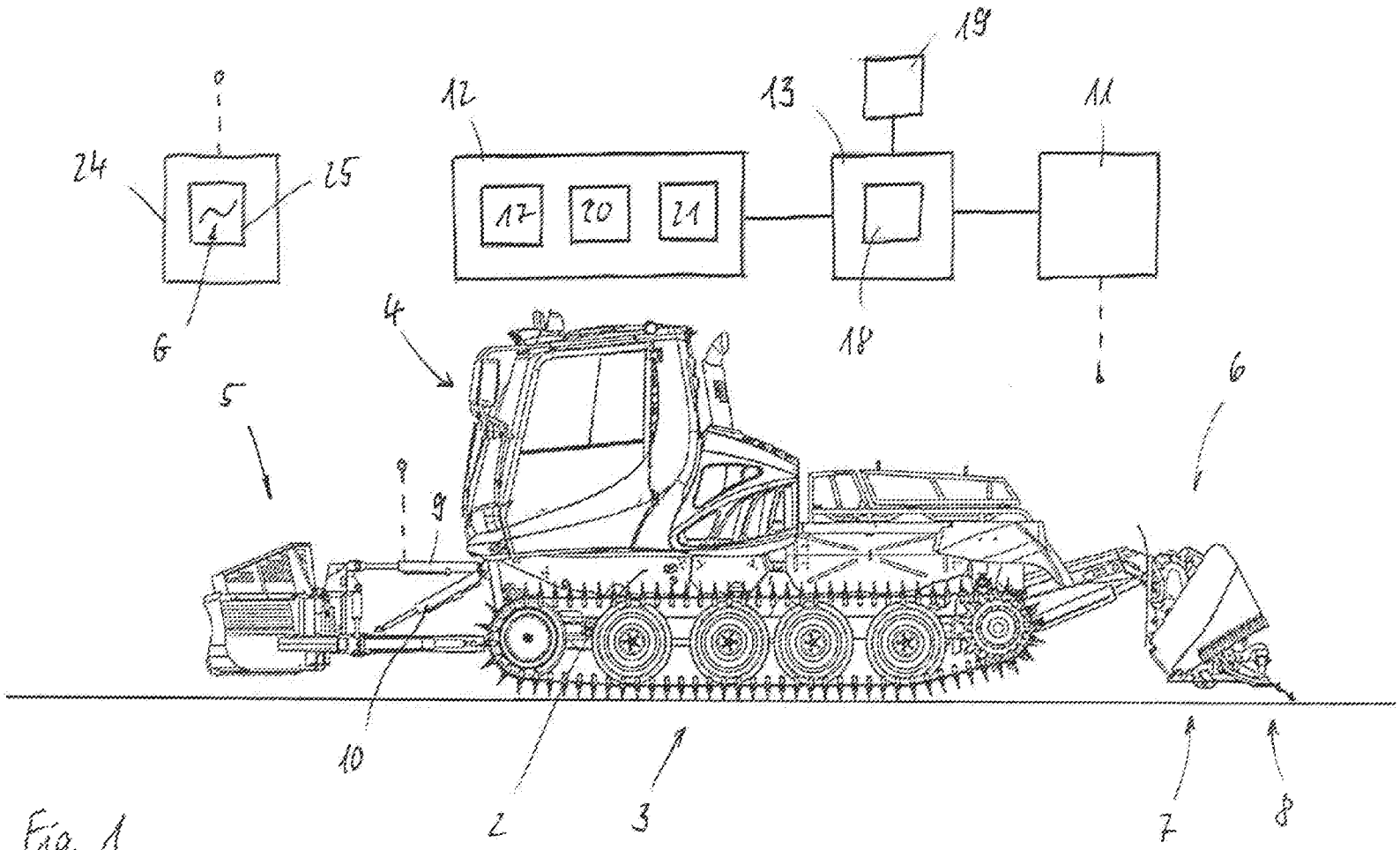
FIG. 1 shows a schematic side view of an embodiment of a piste grooming vehicle according to the invention, wherein individual components of the piste grooming vehicle are illustrated in the manner of a highly simplified block diagram.

According to FIG. 1, a piste grooming vehicle 1 is provided in the form of a piste groomer for grooming a ski piste or snowboard piste. The piste grooming vehicle 1 has a structural design which is basically known per se with an elongate vehicle supporting frame 2, a caterpillar track 3 which is arranged on the bottom on the vehicle supporting frame 2, a driver's cab 4 which is arranged in a front region on the vehicle supporting frame 2, and two piste grooming devices 5 and 6 which are arranged on the front and rear on the vehicle supporting frame 2. The caterpillar track 3 and the two piste grooming devices 5 and 6 are driven hydraulically in a basically known fashion, wherein the operational energy which is necessary for this is made available by a central diesel assembly which is not shown in more detail.

The piste grooming device 6 which is arranged on the rear is detachably arranged on a rear-mounted device carrier (not designated in more detail) which can be varied in respect of height and inclination relative to the vehicle supporting frame 2 by means of hydraulic actuating elements. The piste grooming device 6 here has a snow blower 7 and a smoothing device 8, which smoothing device 8 is positioned rearwardly of the snow blower 7 and is also referred to as a finisher. In this respect, the design of the piste grooming device 6 is basically known.

The piste grooming device arranged at the front is embodied here in the form of a snow plow 5 which is supported by means of hydraulic actuating cylinders 9, 10 on the vehicle supporting frame 2 and is movable in a lifting and pivoting fashion relative thereto. In the same way as the piste grooming device 6, the piste grooming device 5 is basically known per se, so that there is no need to go into more detail on the further method of functioning and structural configuration.

In addition, the piste grooming vehicle 1 has a control device 11 which is illustrated in FIG. 1 in a schematically simplified fashion in the manner of a block diagram. The control device 11 serves for actuating the hydraulic actuating cylinders 9, 10 for changing the location and position of the snow plow 5, which is to be clarified with reference to a signal line, which is not denoted in more detail and is indicated by dashed lines. In an embodiment which is not illustrated in more detail in the drawings, the control device can alternatively or additionally be configured to actuate the piste grooming device 6 which is arranged on the rear. Furthermore, the piste grooming vehicle 1 has a detection device 12 and a determining device 13. In this context, the detection device 12 is connected to the determining device 13 via a signal line (not denoted in more detail), and said determining device 13 is connected to the control device 11 by means of a signal line (not denoted in more detail). The signal lines can be embodied in a wireless or wire-bound fashion. The rest of the design and the method of functioning of, in particular, the detection device 12, determining device 13 and control device 11 are described in more detail below with reference to FIG. 2.

Figure 2:
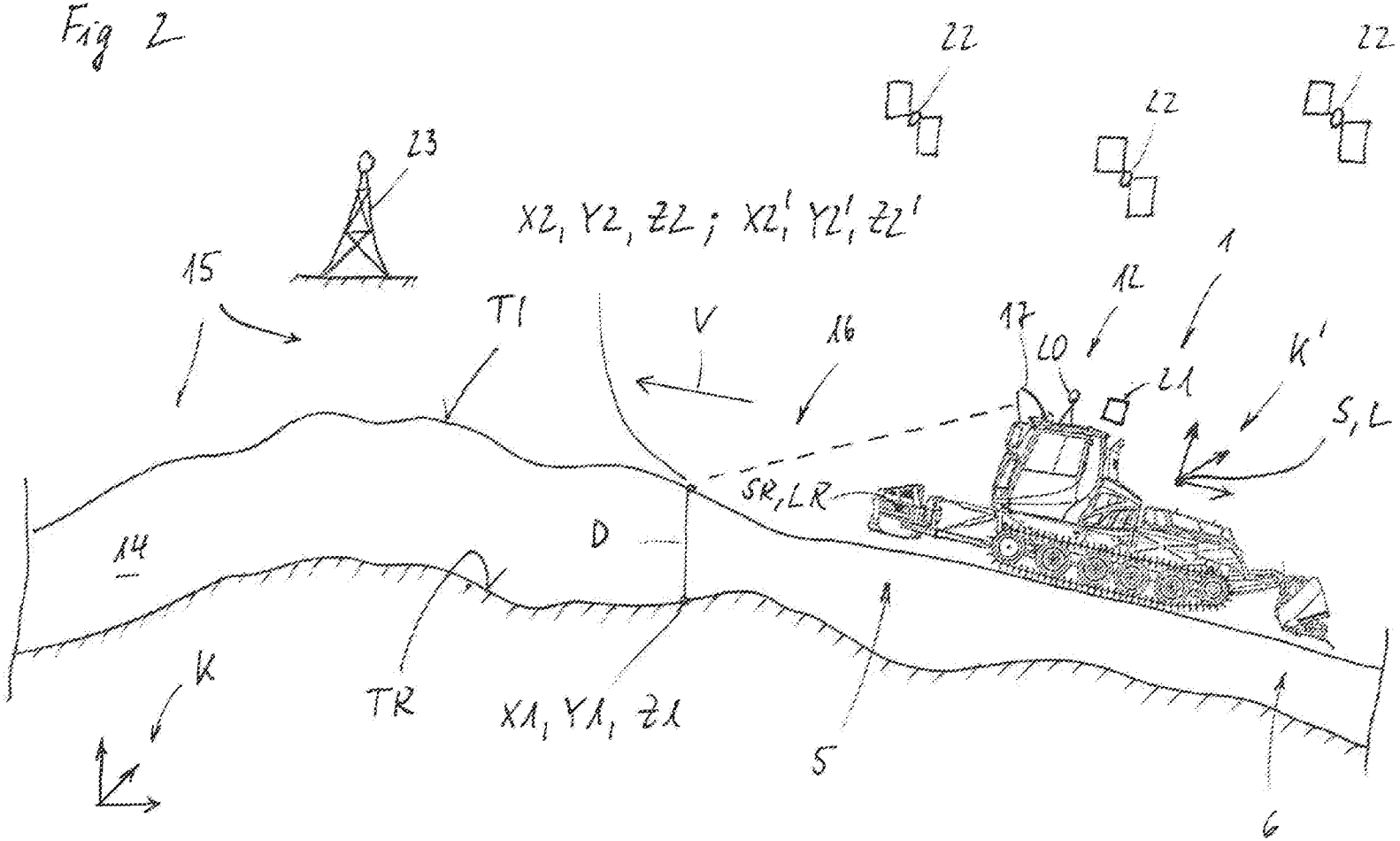
FIG. 2 shows a schematic side view of the piste grooming vehicle according to FIG. 1 in an operating state during the grooming of a schematically illustrated ski piste or snowboard piste which is covered with snow.

FIG. 2 shows the piste grooming vehicle 1 in a schematic operational state during preparation of a piste 15 which is covered with snow 14. During the operation illustrated there, the piste grooming vehicle 1 moves over the piste 15 along a forward travel direction V, wherein the piste 15 is prepared with the piste grooming device 5 and/or the piste grooming device 6.

It is also clear from FIG. 2 that the piste 15 has an actual topography TI. The actual topography TI has hills, depressions, transitions between gradients and the like. This actual topography TI is to be differentiated from a virtual reference topography TR of the piste 15. The reference topography TR relates here to a state of the piste 15 which is not covered with snow 14. In an exemplary embodiment which is not illustrated in more detail in the drawing, the reference topography TR can alternatively relate to a state of the piste 15 which is covered more or less with snow 14 at a previous point in time. As a further alternative, the reference topography TR can describe a setpoint state, to be established by means of the piste grooming vehicle 1, of the piste 15, and therefore a type of setpoint surface or setpoint configuration.

The detection device 12 is configured to detect the actual topography TI of a piste section 16 which is positioned in front of the piste grooming vehicle 1 with respect to the forward travel direction V. For this purpose, the detection device 12 has here a lidar system 17. The lidar system 17 serves for performing laser-assisted scanning, in terms of measuring technology, of the piste 15, wherein the basic method of functioning of lidar systems is known per se so that there is no need here to give more details thereon. The lidar system 17 is arranged oriented in the forward travel direction V, so that the piste section 16 which is positioned in front of the piste grooming vehicle 1 can be detected in terms of measuring technology by means of the lidar system 17. In this context, the piste 15 is, expressed in simplified terms, scanned optically row by row, wherein the travel movement of the piste grooming vehicle 1 along the forward travel direction V causes this row-by-row scanning to move forward along the piste 15.

The determining device 13 (FIG. 1), which determining device 13 is connected to the detection device 12, is configured to determine a geometric deviation between the actual topography TI and the reference topography TR. For this purpose, the determining device 13 has here a processor unit 18 (FIG. 1) which is configured to perform data-based evaluation of the actual topography TI detected by means of the detection device 12 and the reference topography TR. The reference topography TR is stored here in the form of a data-based surface model in a memory unit 19 (FIG. 1) which is assigned to the determining device 13. The determining device 13 determines, for the comparison between the actual topography TI and the reference topography TR described above, at least one differential value D between coordinates X2, Y2, Z2 of the actual topography TI and coordinates X1, Y1, Z1 of the reference topography TR. In this context, the differential value D can represent, for example, a scalar or a vectorial deviation between the actual topography TI and the reference topography TR. The control device 11 (FIG. 1), which control device 11 is connected to the determining device 13, is configured to actuate the hydraulic actuating cylinders 9, 10 of the snow plow 5 in accordance with the differential value D. That is to say, the snow plow 5 is actuated by means of the control device 11 in accordance with the previously determined deviation between actual topography TI and reference topography TR of the piste 15. In the present case, the reference topography TR describes the piste 15 which is not covered with snow 14, so that the differential value D describes a current snow depth, as a function of which the snow plow 5 can be actuated.

Since the detection device 12 and, in particular, the lidar system 17 are arranged on the piste grooming vehicle 1, the detection, described above, of the actual topography TI takes place with respect to a movable local vehicle coordinate system K' which is assigned to the piste grooming vehicle 1. That is to say, to put it simply, the travel movements of the piste grooming vehicle 1 superimpose the detection of the piste 15 in terms of measuring technology. On the basis of this superimposition it is not readily possible to establish a relationship between coordinates X2', Y2', Z2' of the piste 15, which are detected by means of the detection device 12 and which are related to the vehicle coordinate system K', and the coordinates X1, Y1, Z1 of the reference topography TR. This is because the latter are related here to a global reference coordinate system K. The global reference coordinate system K can also be referred to as a GPS coordinate system. In order to be able to establish a relationship between the coordinates X2', Y2', Z2', which relate to the local vehicle coordinate system K', and the coordinates X1, Y1, Z1, which relate to the global reference coordinate system K, it is necessary to determine the location and position of the piste grooming vehicle 1 and therefore of the vehicle coordinate system K' in relation to the global reference coordinate system K. The detection device 12 is, for this purpose, configured to detect a location S and a position L of the piste grooming vehicle 1—and therefore of the vehicle coordinate system K'—with respect to the reference coordinate system K. The detection device 12 for this has a GPS unit 20 and a position-measuring unit 21. For this purpose, the GPS unit 20 interacts in a basically known fashion with a basically known differential GPS location system 22, 23, which has a plurality of locating satellites 22 and a reference unit 23. The reference unit 23 is arranged in a positionally fixed fashion at a location in the vicinity of the piste 15 which is known with respect to the reference coordinate system K, and said reference unit 23 serves to determine correction data which permit detection of the location S improved with respect to its accuracy. Since the basic design and the method of functioning of differential GPS locating systems is known, there is no need to give more details here. The position-measuring unit 21 is configured to detect the position L of the piste grooming vehicle 1 and/or of the vehicle coordinate system K'. For this purpose, the position-measuring unit 21 can have, for example, at least one inertial sensor (not denoted in more detail) for detecting a longitudinal inclination and/or transverse inclination of the piste grooming vehicle 1. Such inertial sensors for measuring the inclination are basically known per se.

The location S and position L which are determined in this way can be used as the basis for a coordinate transformation of the coordinates X2', Y2', Z2', determined by means of the lidar system 17, of the actual topography TI into the reference coordinate system K. The processor unit 18 is configured here to perform such a transformation of the coordinates of the actual topography TI into the reference coordinate system K. That is to say the coordinates X2', Y2', Z2' which are detected by means of the lidar system 17 are converted by means of the processor unit 18 in a data-based fashion, with recourse to basically known geometric transformation relationships, into the data X2, Y2, Z2 which are referred to the reference coordinate system K. The differential value D is calculated by means of the processor unit 18 by means of the transformation which is described above. The differential value D is here a difference between the vertical coordinate Z2 of the actual topography TI and the vertical coordinate Z1 of the reference topography TR. In this respect, the differential value D describes an absolute depth of the snow 14 above the snow-free base of the piste 15. In this context, the control unit 11 actuates the snow plow 5 with respect to a change in a location SR and/or a position LR of the snow plow 5 relative to the determined actual topography TI. The position SR is here a lifting position, and the position LR is here a longitudinal inclination and/or transverse inclination of the snow plow 5 relative to the surface of the piste 15.

The piste grooming vehicle 1 additionally has a display device 24 which is configured to display the determined actual topography TI in the form of a virtual terrain model G. The display device 24 is connected to the determining device 13 by means of a signal line which is indicated by dashed lines. In the present case, the determining device 13 is configured to determine the virtual terrain model G on the basis of the actual topography TI, determined by means of the lidar system 17, with respect to the global reference coordinate system K. The virtual terrain model G can be displayed in the form of a two-dimensional and/or three-dimensional surface model of the piste section 16 positioned in front, by means of the display device 24. For example, the virtual terrain model G can permit obstacles located on the piste section 16 to be detected. In this respect, the display device 24 serves, in particular, as a type of visual aid of a vehicle driver of the piste grooming vehicle 1 in the case of visibility conditions being restricted owing to the weather and/or time of day.

In the embodiment shown, the display device 24 has a headsup display 25 which, in order to display the virtual terrain model G, is arranged in the region of a front windshield (not denoted in more detail) of the piste grooming vehicle 1. In an embodiment which is not illustrated in more detail in the drawing, the display device 24 can have a screen and/or data glasses as an alternative or in addition to the headsup display 25.

Figure 3:
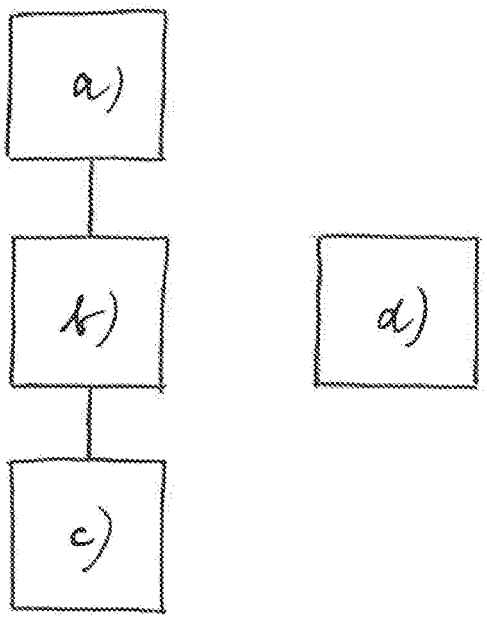
FIG. 3 shows a schematic block diagram of an embodiment of a method according to the invention.
Figure 4:
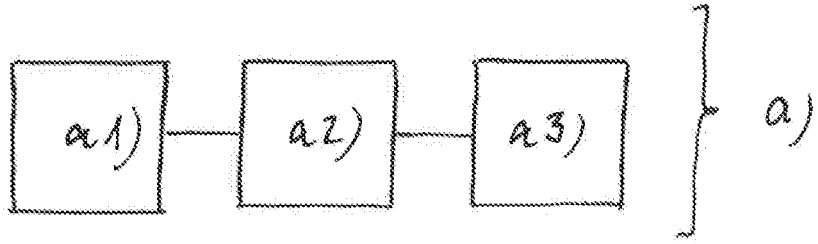
FIG. 4 shows a schematic block diagram of further details of the method according to FIG. 3.

FIGS. 3 and 4 illustrate once more the method which has already been described with respect to FIG. 2, for operating the piste grooming vehicle 1. In a first step a), the actual topography TI of the piste section 16, positioned in front of the piste grooming vehicle 1 in the forward travel direction V thereof, of the piste 15 is detected. This is done here by means of the lidar system 17 of the detection device 12. In a further step b), the at least one differential value D between the coordinates X2, Y2, Z2 of the actual topography TI and the coordinates X1, Y1, Z1 of the reference topography TR of the piste 15 is determined. This is done here by means of the processor unit 18. In a further step c), at least one of the piste grooming devices 5, 6 is actuated in accordance with the differential value D. This is done here by means of the control device 11, wherein the front-side piste grooming device 5 is actuated.

Further partial aspects of the detection of the actual topography TI according to step a) are clarified by means of FIG. 4. Here, in a step a1), the coordinates X2', Y2', Z2' of the actual topography TI are initially detected with respect to the local vehicle coordinate system K'. This is because the detection device 12 and the lidar system 17 are mounted together on the piste grooming vehicle 1 so as to be capable of moving therewith. In a further step a2), the location S and the position L of the piste grooming vehicle 1—and therefore of the local vehicle coordinate system K'—are detected with respect to the reference coordinate system K on which the coordinates X1, Y1, Z1 of the reference topography TR are based. The detection of the location and position is carried out here by means of the GPS unit 20 and the position-measuring unit 21 of the detection device 12. In a further step, the coordinates X2', Y2', Z2' of the actual topography TI are transformed into the reference coordinate system K in accordance with the determined location S and the position L. This coordinate transformation is carried out here by means of the processor unit 18 of the determining device 13, wherein transformation relationships which are basically known per se are used as the basis.

In a further step d) of the method clarified by means of FIG. 3, the actual topography which was determined previously is displayed in the form of the virtual terrain model G. In the embodiment shown, this is done by means of the headsup display 25.

The invention claimed is:

1. A piste grooming vehicle comprising:

at least one piste grooming device for preparing a piste;

a detection device configured to detect an actual topography of a piste section, positioned in front of the piste grooming vehicle in a forward travel direction thereof, of the piste, the detection device being configured to: detect coordinates of the actual topography with respect to a local vehicle coordinate system assigned to the piste grooming vehicle; and detect a location and a position of the piste grooming vehicle and therefore of the local vehicle coordinate system with respect to a global reference coordinate system, the detection device comprising:

a GPS unit configured to detect the location of the piste grooming vehicle with respect to the global reference coordinate system; and a position measuring unit configured to detect the position of the piste grooming vehicle with respect to the global reference coordinate system by measuring a longitudinal inclination and/or a transverse inclination of the piste grooming vehicle;

a determining device connected to the detection device and configured to transform the detected coordinates of the actual topography into the global reference coordinate system in accordance with the detected location and the detected position of the local vehicle coordinate system, the determining device being further configured to determine at least one differential value between the transformed coordinates of the actual topography and coordinates of a reference topography of the piste, the coordinates of the reference topography being based on the global reference coordinate system, to determine an actual topography of the piste section with respect to the global reference coordinate system; and a control device connected to the determining device and configured to actuate the at least one piste grooming device in accordance with the at least one determined differential value.

2. The piste grooming vehicle according to claim 1, wherein the detection device has a lidar system arranged and oriented in the forward travel direction such that the piste section positioned in front of the piste grooming vehicle is detected by the lidar system.

3. The piste grooming vehicle according to claim 1, wherein the determining device has a processor unit configured to perform data-based transformation of the detected coordinates of the actual topography into the global reference coordinate system and to calculate the at least one differential value between the transformed coordinates of the actual topography and the coordinates of the reference topography.

4. The piste grooming vehicle according to claim 1, wherein the at least one piste grooming device comprises a snow plow arranged on a front, with respect to the forward travel direction, of the piste grooming vehicle, the control device being configured to actuate the snow plow to change a location and/or a position of the snow plow relative to the determined actual topography.

5. The piste grooming vehicle according to claim 1, further including a display device configured to display the determined actual topography in the form of a virtual terrain model.

6. The piste grooming vehicle according to claim 5, wherein the display device has a screen and/or a head up display and/or data glasses.

7. The piste grooming vehicle according to claim 1, wherein the control device is configured to automatically actuate the at least one piste grooming device in accordance with the at least one determined differential value.

8. The piste grooming vehicle according to claim 1, wherein the at least one differential value is a difference between an altitude coordinate of the transformed coordinates of the actual topography and an altitude coordinate of the reference topography.

9. A piste grooming vehicle for preparing a piste, comprising:

a piste grooming device mounted on the piste grooming vehicle for preparing a piste;

a detection device disposed on the piste grooming vehicle for movement therewith, the detection device comprising:

a measuring device disposed and configured to detect coordinates of an actual topography of a piste section located in front of the piste grooming vehicle, prior to when the piste section is travelled on by the piste grooming vehicle, in relation to a local vehicle coordinate system of the piste grooming vehicle;

a GPS unit configured to detect a location of the piste grooming vehicle with respect to a global reference coordinate system; and a position measuring unit configured to detect an orientation of the piste grooming vehicle with respect to the global reference coordinate system by measuring a longitudinal inclination and/or a transverse inclination of the piste grooming vehicle;

a determining device in communication with the detecting device and comprising a processor configured to determine at least one differential value between the coordinates of the actual topography and coordinates of a reference topography of the piste representing a current snow depth; and a control device in communication with the determining device and configured to automatically actuate the at least one piste grooming device in accordance with the at least one determined differential value.

10. The piste grooming vehicle according to claim 9, wherein the processor of the determining device is configured to transform the coordinates of the actual topography into the global reference coordinate system in accordance with the detected location and the detected orientation of the local vehicle coordinate system.

11. The piste grooming vehicle according to claim 9, wherein the measuring device comprises a lidar system disposed on the piste grooming vehicle so as to be oriented in a forward travel direction thereof.

12. The piste grooming vehicle according to claim 9, wherein the piste grooming device comprises a snow plow disposed on a front of the piste grooming vehicle, the control device being configured to automatically actuate the snow plow to change a location and/or an orientation of the snow plow relative to the determined actual topography.

13. The piste grooming vehicle according to claim 9, further including a display device configured to display the determined actual topography as a virtual terrain model.

14. The piste grooming vehicle according to claim 13, wherein the display device comprises a screen and/or a head up display and/or data glasses.

* * * * *